US007216657B2

(12) United States Patent
Choi

(10) Patent No.: US 7,216,657 B2
(45) Date of Patent: May 15, 2007

(54) WATERPROOF STRUCTURE OF VENTILATING WINDOW FOR TENT

(76) Inventor: Kyong Jal Choi, 312-301 Beach Apt., 29/5, 148 Namcheon-Dong, Suyoung-Ku, Pusan (KR) 613-101

( * ) Notice: Subject to any disclaimer, the term of this patent is extended or adjusted under 35 U.S.C. 154(b) by 148 days.

(21) Appl. No.: 10/758,133

(22) Filed: Jan. 16, 2004

(65) Prior Publication Data

US 2005/0120649 A1 Jun. 9, 2005

(30) Foreign Application Priority Data

Dec. 3, 2003 (KR) ..... 10-2003-0087144

(51) Int. Cl.
*E04H 15/14* (2006.01)

(52) U.S. Cl. ..... 135/93; 135/117

(58) Field of Classification Search ..... 135/93, 135/91, 117

See application file for complete search history.

(56) References Cited

U.S. PATENT DOCUMENTS 3,024,717 A * 3/1962 Rozek ..... 454/275

4,265,261 A * 5/1981 Barker ..... 135/100

* cited by examiner

*Primary Examiner*—Robert Canfield
(74) *Attorney, Agent, or Firm*—Mayer Brown Rowe & Maw LLP

(57) ABSTRACT

The ventilating window of tent according to the present invention comprises a double-side waterproof fabric 111, which is sewn and attached to the rim portion of the ventilating window 102 of the body fabric 101 together with the cover fabric 105, and in which the net yarn fabric 103 is sewn and attached through the outline fabric 104 to the rim portion of the ventilation hole 112 formed inside, and of which both sides are waterproof coated so as for a waterproof tape to be adhered; an inner waterproof tape 122, which is attached to the inlet of the portion that is closely contacted by the sewing line of the double-side waterproof fabric 111 and the cover fabric 105 to prevent rainwater from penetrating through the sewing line part of the double-side waterproof fabric 111 and the cover fabric 105; and an outer waterproof tape 121 that is attached to the sewing line of the body fabric 101 and the double-side waterproof fabric 111 and the border line of these to prevent rainwater from penetrating through the sewing line part of the body fabric 101 and the double-side waterproof fabric 111.

1 Claim, 7 Drawing Sheets

PRIOR ART

PRIOR ART

Prior Art

WATERPROOF STRUCTURE OF VENTILATING WINDOW FOR TENT

BACKGROUND OF THE INVENTION

1. Field of the Invention

The present invention relates to a ventilating window of a tent, and more specifically to a waterproof structure of a ventilating window for a tent, in which an outer rim portion is sewn and attached to the ventilating window rim portion of a body fabric together with a cover fabric, and an outline fabric of net yarn fabric is sewn and attached to the ventilation hole portion formed inside, and an inner waterproof tape is attached to the inlet of the part that is closely contacted by a sewing line of a double-side waterproof-coated double-side waterproof fabric and the cover fabric to prevent rainwater from penetrating through the sewing line part of the double-side waterproof fabric and the cover fabric, and outer waterproof tapes are attached to the inner sewing line of the body fabric and the double-side waterproof fabric and the border line of these to prevent rainwater from penetrating though the sewing line part of the body fabric and the double-side waterproof fabric, so that rainwater is prevented from penetrating through the ventilating window part of tent.

2. Description of the Related Art

The construction of a conventional ventilating window for tent is as shown in FIGS. 1 through 4.

The construction of this ventilating window comprises a ventilating window 2; a net yarn fabric 3 that is attached to the rim portion of the ventilating window 2 by sewing an outline fabric 4; a cover fabric 5 that is sewn and attached to the outside of a body fabric 1 enclosing the net yarn fabric 3 so that the bottom is opened while a space is formed outside the net yarn fabric 3; and a waterproof tape 6 that is attached to the sewing line part of the body fabric 1 for the waterproofing of the sewing line part of the cover fabric 5 and the body fabric 1.

Below is described the action of a conventional ventilating window for tent having such a construction.

First, the ventilating window 2 formed on the body fabric 1 makes the air inside the tent communicate with the outside so that the inside of the tent can be maintained pleasant.

And, the net yarn fabric 3 that is sewn and attached to the rim portion of the ventilating window 2 through the outline fabric 4 can prevent mosquitoes or flies from flying in through the ventilating window 2.

Also, the cover fabric 5 that is sewn and attached making a space outside the ventilating window 2 plays a role of intercepting rainwater or sunlight through the net yarn fabric 3.

Thus, in the prior art, to waterproof the sewing line part of the cover fabric 5 and the body fabric 1, a waterproof tape 6 is attached to the sewing line part formed on the inside of the body fabric 1.

However, although rainwater does not penetrate through the sewing line part attached with the waterproof tape 6, there is no waterproofing means equipped in the close contact part of the body fabric 1 and the cover fabric 5, so rainwater penetrates through the close contact part, as shown in FIGS. 3 and 4.

So the rainwater that has penetrated through the close contact part of the body fabric 1 and the cover fabric 5 flows into the tent through the outline fabric 4 of the net yarn fabric 3 and the sewing line part of the body fabric 1, eventually making a problem of rainwater staying inside the tent.

Especially, only the inner surface of the body fabric 1 is waterproof coated, so it can be waterproofed by attaching the waterproof tape 6; but the outer surface of the body fabric 1 is not waterproof coated, so a waterproof tape cannot be attached.

For reference, in order to attach waterproof tapes to the fabrics making up a tent, the surface of the reverse of the fabric should be waterproof coated.

But waterproof coating both sides of all the fabrics causes increase in the cost and the number of work processes, so it is a general practice to coat the outer surface only, namely, one side of the fabric.

Thus, the conventional ventilating window of tent is not equipped with a proper waterproof system, so it has a problem of causing many inconveniences on rainy days.

SUMMARY OF THE INVENTION

Therefore, it is an object of the present invention to provide a waterproof structure of a ventilating window for tent that can block the penetration of rainwater through the ventilating window part of tent.

In one aspect of the present invention, there is provided a tent having a ventilating window that is formed for the purpose of the ventilation of the body fabric, a net yarn fabric that is sewn and attached to the rim portion of the ventilating window through an outline fabric, and a cover fabric that is sewn and attached to the outside of the body fabric enclosing the net yarn fabric so that the bottom is opened while a space is formed outside the net yarn fabric, a waterproof structure of the ventilating window of tent characterized by comprising: a double-side waterproof fabric, which is sewn and attached to the rim portion of the ventilating window of a body fabric together with a cover fabric, and to which a net yarn fabric is sewn and attached to the rim portion of the ventilation hole portion formed inside, and both sides of which are waterproof coated so as for a waterproof tape to be adhered; an inner waterproof tape, which is attached to the inlet of the part that is closely contacted by the sewing line of the double-side waterproof fabric and the cover fabric to prevent rainwater from penetrating through the sewing line part of the double-side waterproof fabric and the cover fabric; and an outer waterproof tape, which is attached to the inner sewing line of the body fabric and the double-side waterproof fabric and the border line of these to prevent rainwater from penetrating through the sewing line part of the body fabric and the double-side waterproof fabric.

BRIEF DESCRIPTION OF THE DRAWINGS

Other objects and aspects of the present invention will become apparent from the following description of embodiments with reference to the accompanying drawings in which.

DESCRIPTION OF THE PREFERRED EMBODIMENT

Figure 1:
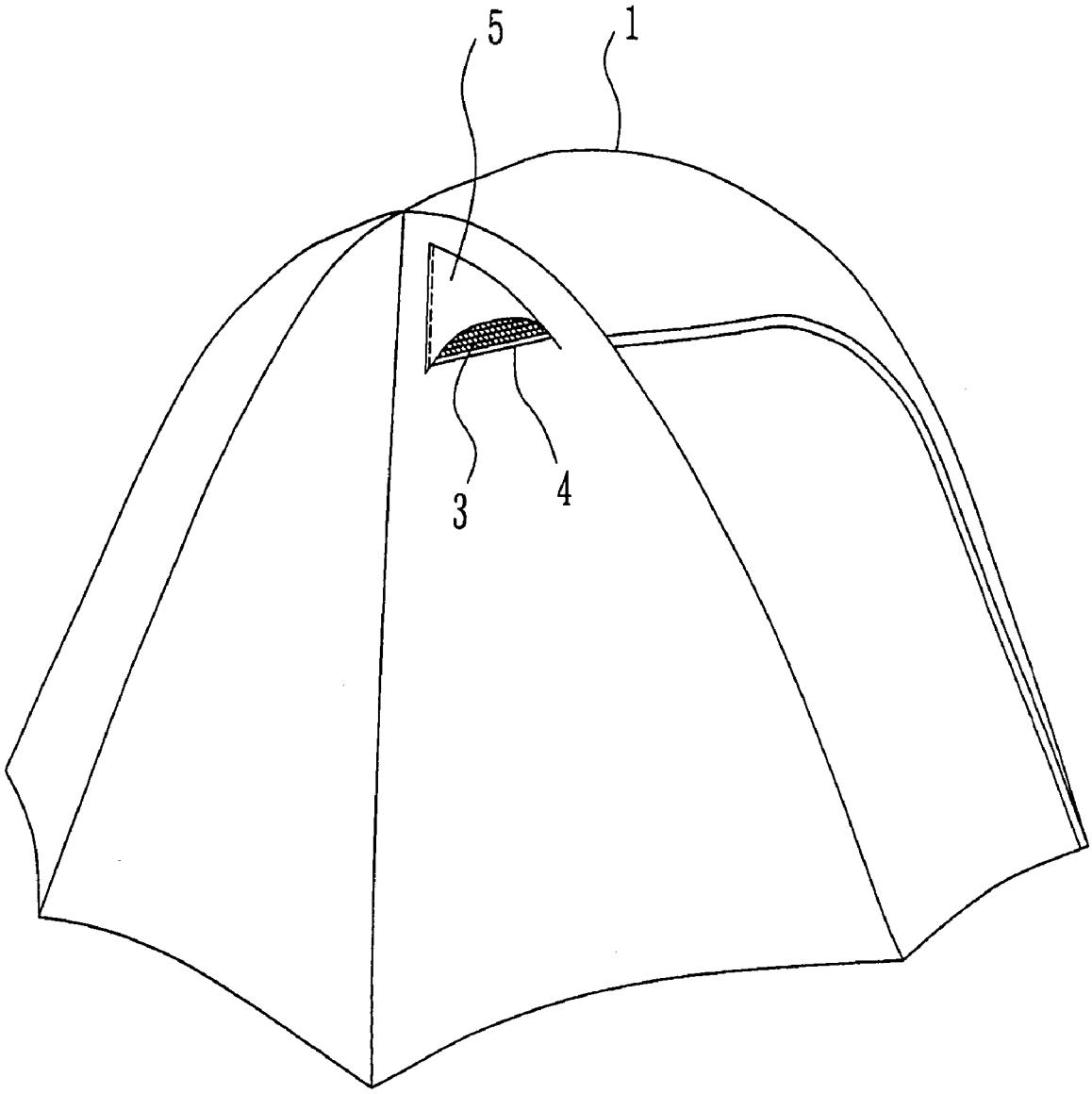
FIG. 1 is a perspective view showing a ventilating window formed in a conventional tent.
Figure 2:
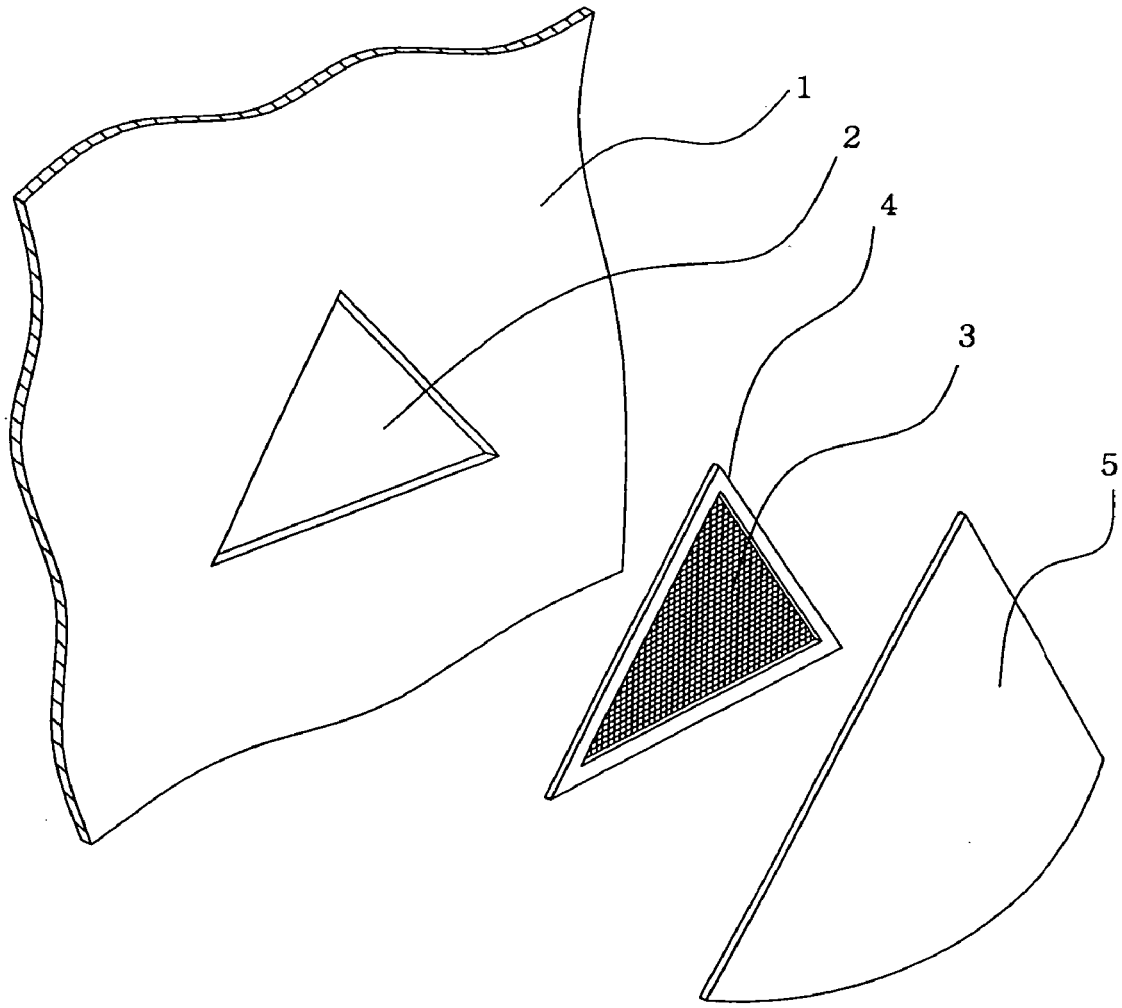
FIG. 2 is an exploded perspective view for describing the construction of a conventional ventilating window.
Figure 3:
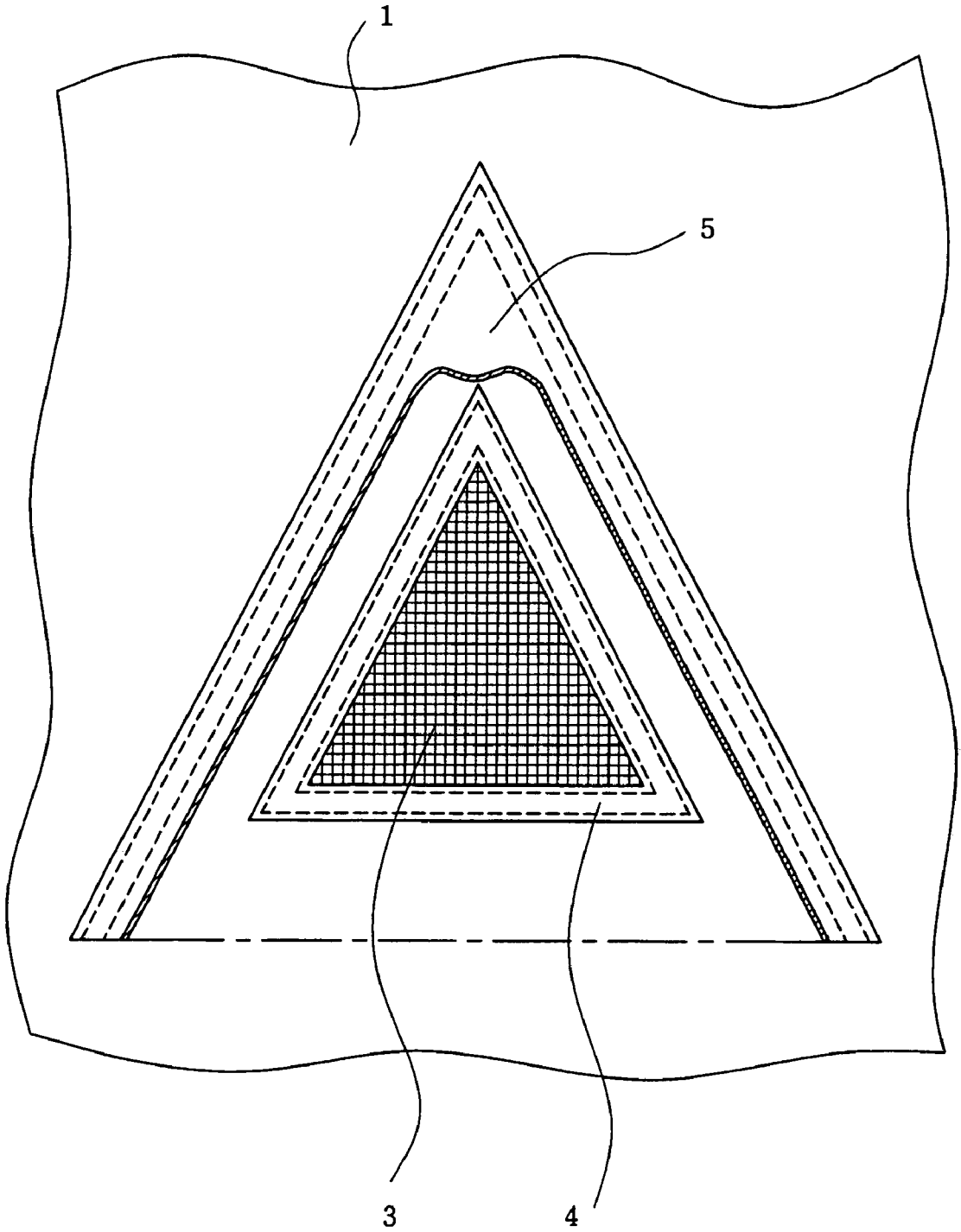
FIG. 3 is a partly cut-out front view for describing the rainwater penetration process of a conventional ventilating window.
Figure 4:
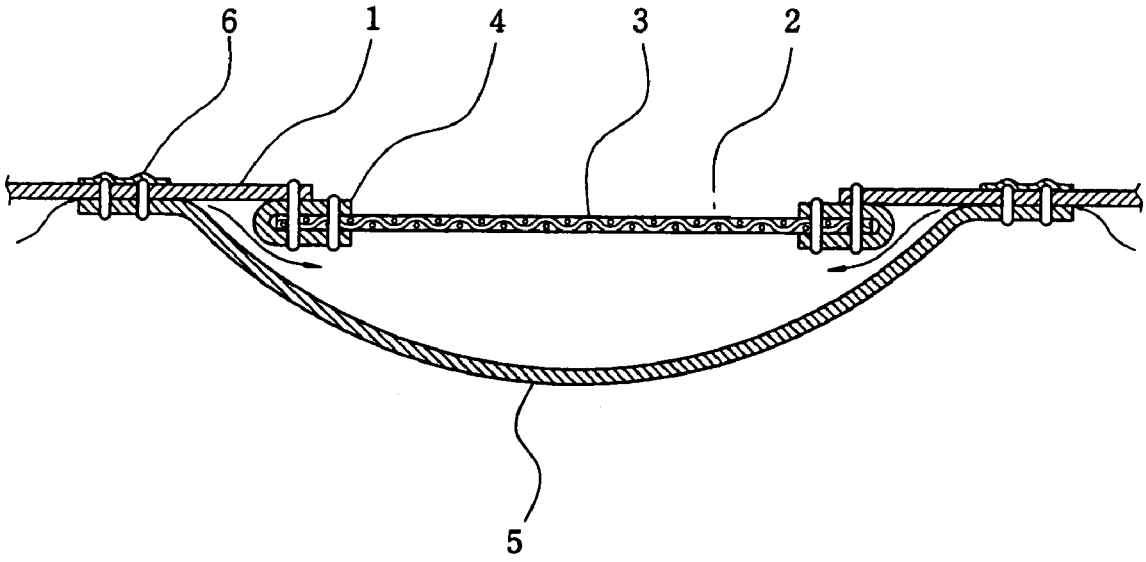
FIG. 4 is a sectional view for describing the rainwater penetration process of a conventional ventilating window.

Hereinafter, the present invention will be described in more detail referring to the drawings.

Figure 5:
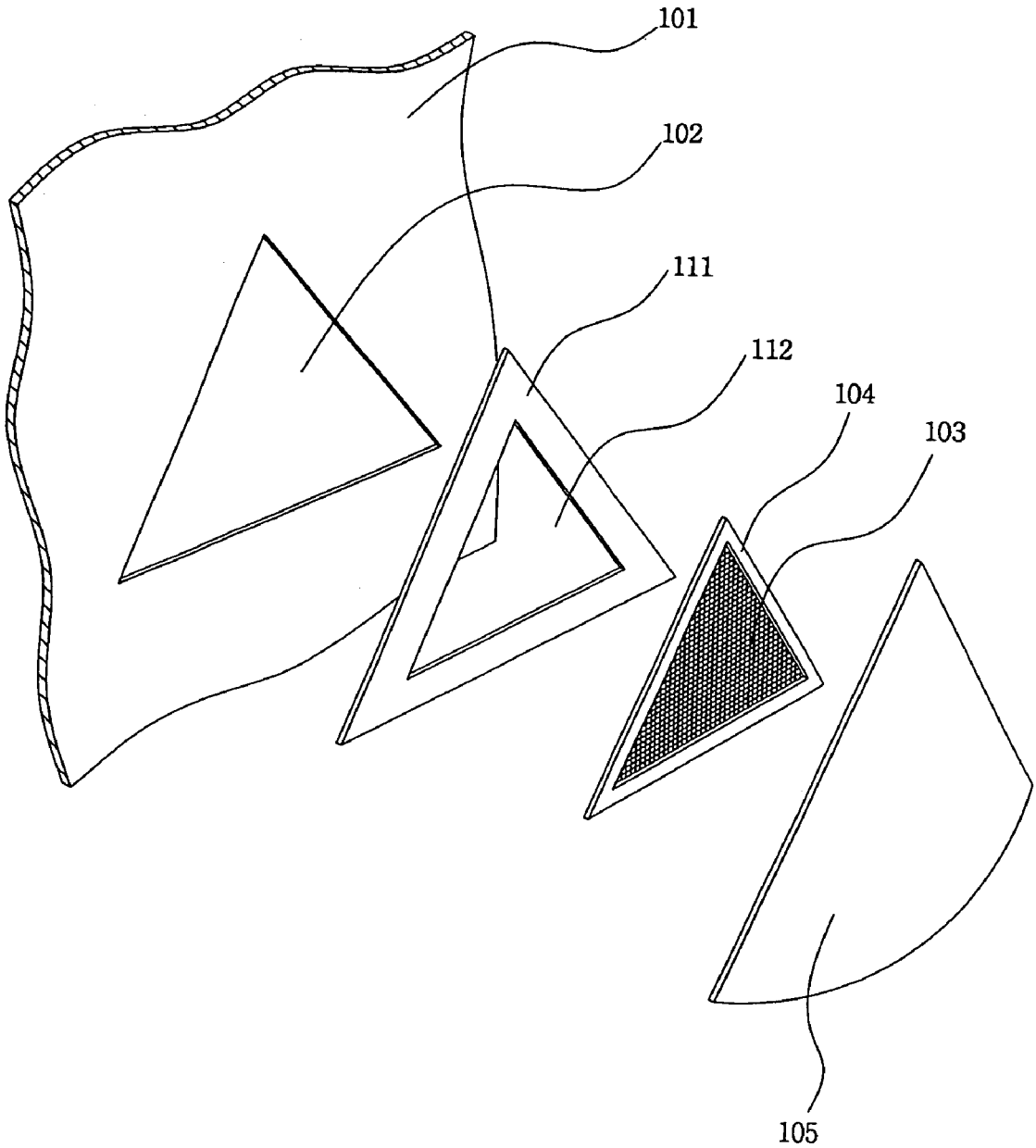
FIG. 5 is an exploded view for describing the construction of the ventilating window of the present invention.
Figure 6:
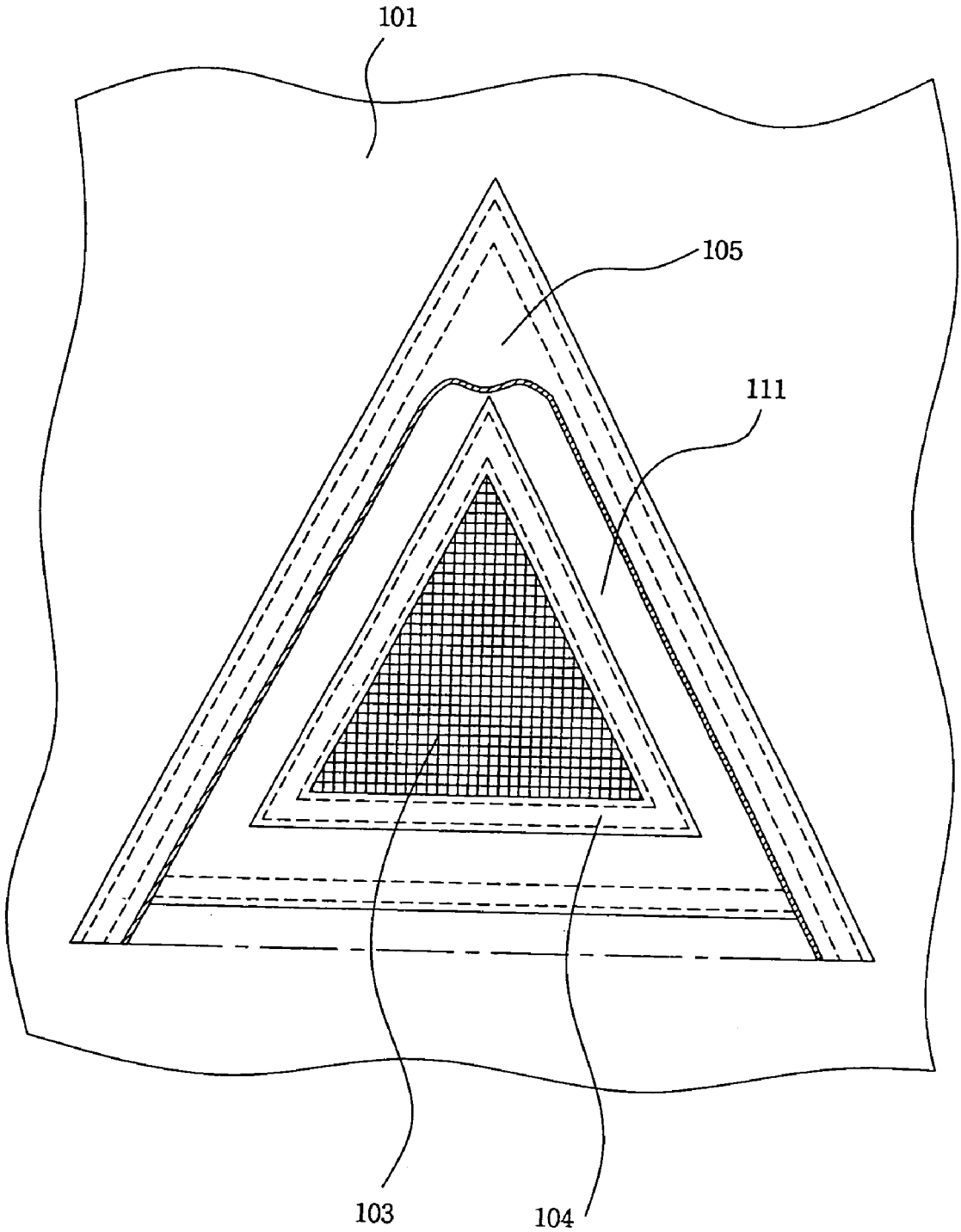
FIG. 6 is a partly cut-out front view for describing the assembled state of the ventilating window of the present invention.

First, as shown in FIG. 5, the ventilating window of tent comprises a ventilating window 102 that is formed on the body fabric 101 for the purpose of ventilation, a net yarn fabric 103 that is sewn and attached to the rim part of the ventilating window 102 through an outline fabric 104, and a cover fabric 105 that is sewn and attached to the outside of the body fabric 101 enclosing the net yarn fabric 103 so that the bottom is opened while a space is formed outside the net yarn fabric 103.

In a tent of such a construction, the ventilating window of tent according to the preferred embodiment of the present invention comprises a double-side waterproof fabric 111, which is sewn and attached to the rim portion of the ventilating window 102 of the body fabric 101 together with the cover fabric 105, and in which the net yarn fabric 103 is sewn and attached through the outline fabric 104 to the rim portion of the ventilation hole 112 formed inside, and of which both sides are waterproof coated so as for a waterproof tape to be adhered; an inner waterproof tape 122, which is attached to the inlet of the portion that is closely contacted by the sewing line of the double-side waterproof fabric 111 and the cover fabric 105 to prevent rainwater from penetrating through the sewing line part of the double-side waterproof fabric 111 and the cover fabric 105; and an outer waterproof tape 121 that is attached to the sewing line of the body fabric 101 and the double-side waterproof fabric 111 and the border line of these to prevent rainwater from penetrating through the sewing line part of the body fabric 101 and the double-side waterproof fabric 111.

Below is described the action of the ventilating window of tent of such a construction according to the present invention.

First, both sides of the double-side waterproof fabric 111 of the present invention are waterproof coated, so it is possible to attach waterproof tapes 121 and 122 to both sides.

Also, the inner surface of the body fabric 101 to which the double-side waterproof fabric 111 is sewn is waterproof coated and the outer surface of it is not waterproof coated.

Figure 7:
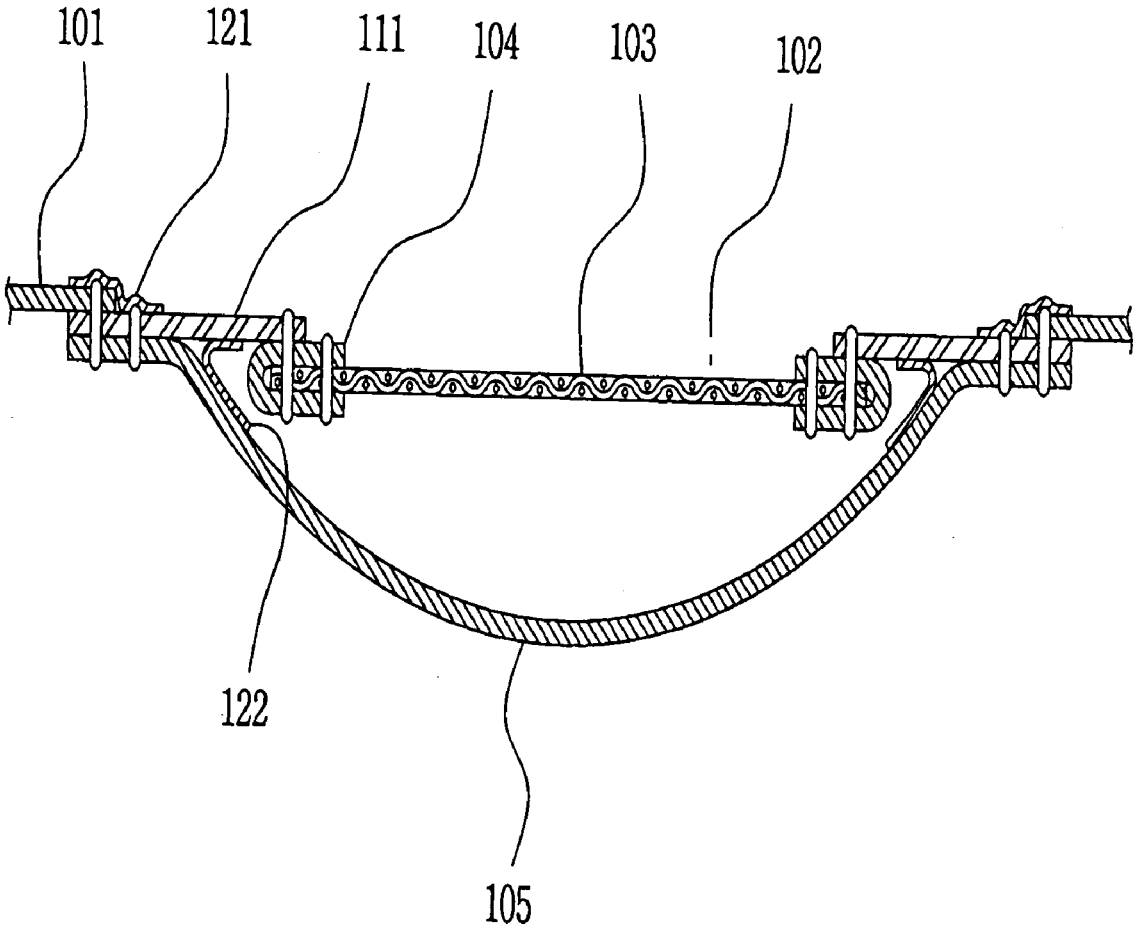
FIG. 7 is a sectional view for describing the assembled state of the ventilating window of the present invention.

Accordingly, it is possible to attach the outer waterproof tape 121 while covering the sewing line formed on the inner surface of the body fabric 101 and the border line of the double-side waterproof fabric 111, as shown in FIG. 7.

By the outer waterproof tape 121 attached in this manner, it is possible to perfectly block the penetration of rainwater though the sewing line part of the body fabric 101 and the double-side waterproof fabric 111.

Also, the cover fabric 105 that is sewn to the body fabric 101 after being closely contacted with the outer surface of the double-side waterproof fabric 111 is waterproof coated in its inner surface and not in its outer surface.

Accordingly, it is possible to attach the inner waterproof tape 122 to the inlet of the part that is closely contacted by the sewing line of the double-side waterproof fabric 111 and the cover fabric 105, as shown in FIG. 7.

By the inner waterproof tape 122 attached in this manner, it is possible to perfectly block the penetration of rainwater through the sewing line part of the double-side waterproof fabric 111 and the cover fabric 105.

As describe above, since it is possible to prevent rainwater from penetrating through the sewing line part of the double-side waterproof fabric and the cover fabric that make up the ventilating window of tent, and at the same it is possible to securely block the penetration of rainwater through the sewing line of the body fabric and the double-side waterproof fabric, it is possible to improve the function as a tent by a thorough waterproof effect and obtain a reliable tent.

What is claimed is:

1. A waterproof structure of the ventilating window for a tent having a ventilating window that is formed for the purpose of the ventilation of the body fabric, a net yarn fabric that is sewn and attached to the rim portion of the ventilating window through an outline fabric, and a cover fabric that is sewn and attached to the outside of the body fabric enclosing the net yarn fabric so that the bottom is opened while a space is formed outside the net yarn fabric, the waterproof structure comprising:

a double-side waterproof fabric, which is sewn and attached to the rim portion of the ventilating window of a body fabric together with a cover fabric, and to which a net yarn fabric is sewn and attached to the rim portion of the ventilation hole portion formed inside, and both sides of which are waterproof coated so as for a waterproof tape to be adhered;

an inner waterproof tape, which is attached to the inlet of the part that is closely contacted by the sewing line of the double-side waterproof fabric and the cover fabric to prevent rainwater from penetrating through the sewing line part of the double-side waterproof fabric and the cover fabric; and an outer waterproof tape, which is attached to the inner sewing line of the body fabric and the double-side waterproof fabric and the border line of these to prevent rainwater from penetrating through the sewing line part of the body fabric and the double-side waterproof fabric.

* * * * *